US007614961B2

(12) United States Patent
Schmutz

(10) Patent No.: US 7,614,961 B2
(45) Date of Patent: Nov. 10, 2009

(54) GOLF PUTTING TEACHING DEVICE AND METHOD

(76) Inventor: David Schmutz, 629 Picasso Ave., Ponte Vedra Beach, FL (US) 32081

( * ) Notice: Subject to any disclaimer, the term of this patent is extended or adjusted under 35 U.S.C. 154(b) by 0 days.

(21) Appl. No.: 12/044,014

(22) Filed: Mar. 7, 2008

(65) Prior Publication Data

US 2009/0227388 A1 Sep. 10, 2009

(51) Int. Cl.
*A63B 69/36* (2006.01)

(52) U.S. Cl. ..... 473/257; 473/266

(58) Field of Classification Search ..... 473/257, 473/258, 260, 261, 262, 264, 265, 266, 267, 473/268

See application file for complete search history.

(56) References Cited

U.S. PATENT DOCUMENTS 3,934,874 A * 1/1976 Henderson ..... 473/265
4,826,174 A * 5/1989 Hoyt, Jr. ..... 473/157
5,294,124 A 3/1994 Florian
5,332,211 A * 7/1994 Rife et al. ..... 473/258
5,350,177 A 9/1994 Furbush, Jr.
5,551,924 A 9/1996 Zumtobel
5,882,266 A 3/1999 Schaum
5,919,096 A 7/1999 Kim
6,019,685 A * 2/2000 Fonseca et al. ..... 473/265
6,371,864 B1 4/2002 Norwood
6,416,420 B1 7/2002 Stark
6,482,099 B1 11/2002 Schaum
6,840,870 B1 * 1/2005 Froggatte ..... 473/265
7,131,910 B2 * 11/2006 Townsend, II ..... 473/278

* cited by examiner

*Primary Examiner*—Nini Legesse
(74) *Attorney, Agent, or Firm*—Paul R. Martin

(57) ABSTRACT

A unitary golf putting teaching device that achieves four goals: teaching proper club head path; teaching proper club face angle at impact; teaching proper posture and proper eye alignment; and teaching green reading.

1 Claim, 2 Drawing Sheets

GOLF PUTTING TEACHING DEVICE AND METHOD

TECHNICAL FIELD OF THE INVENTION

The present invention relates to the general art of golf, and to the particular field of putting practice aids.

BACKGROUND OF THE INVENTION

Golf is a sport in which a player, using several types of clubs, has the objective of getting a ball into each hole on the golf course in the lowest number of strokes. Golf is one of the few ball games that doesn't use a standardized playing area; rather, the game is played on golf "courses," each one of which has a unique design and typically consists of either 9 or 18 separate holes. Golf is defined in the Rules of Golf as "playing a ball with a club from the teeing ground into the hole by a stroke or successive strokes in accordance with the Rules."

Golf competition may be played as stroke play, in which the individual with the lowest number of strokes is declared the winner, or as match play with the winner determined by whichever individual or team posts the lower score on the most individual holes during a complete round. In addition, team events such as fourball have been introduced, and these can be played using either the stroke or match play format. Alternative ways to play golf have also been introduced, such as miniature golf and disc golf.

A round typically consists of 18 holes that are played in the order determined by the course layout. On a nine-hole course, a standard round consists of two successive nine-hole rounds. A hole of golf consists of hitting a ball from a tee on the teeing box, or a marked area designated for the first shot of a hole, a tee shot, and once the ball comes to rest, striking it again. This process is repeated until the ball is in the cup.

Once the ball is on the green, or an area of finely cut grass, the ball is usually putted, or hit along the ground into the hole. The goal of resting the ball in the hole in as few strokes as possible may be impeded by hazards, such as bunkers and water hazards.

Putting is a final stroke to hole out a ball, after driving and approach. To hole out, the centers of a hole cup, the ball, and a putter should be aligned on one plane, before correctly striking the ball.

Putting is a very important part of the game of golf. On a standard par 72 course, half of the allotted strokes toward par are allocated for putting. There are at least two important aspects in learning to be a good putter, these include proper alignment of the putter blade with respect to the target, and proper alignment of the golfer's eyes with respect to the ball. The importance of proper alignment of the putter blade with respect to the target is self evident since the object of putting is to accurately control the trajectory of the ball. The importance of eye position is that without ones eyes directly over the ball, the golfer cannot properly determine and learn the correct relationship between the putter face and the target. The importance of proper eye position in putting was pointed out by Jack Nicholas in his book, *Golf My Way*. One of the difficulties with proper alignment is that the human eye, unaided, is not capable of accurately drawing an imaginary target path between the ball and hole and subsequently aligning the putter and his own eye at the required angles to this line to achieve a successful putt.

Known sighting devices may be broadly divided into four groups. Firstly there are devices which are mounted on the shaft of a putter which are unsatisfactory because they are generally unwieldy, adversely effect the natural balance of a club, and tend to cause parallax.

The second group of sighting devices are specially constructed golf putters. This specification describes a specially constructed golf putter in which is permanently mounted an inclined ball and target aligning mirror and a horizontal eye aligning mirror for aligning the eye of a player. Such golf putters are unsatisfactory primarily because they cannot be used under the rules of golf. It may be useful for a player to train using such a putter however when playing the game he must re-adjust back to his own putter without any sighting device and with the attendant disadvantages of a change in size, shape, weight and particularly balance. The most important disadvantage of this putter is that it is a separate item of equipment which the player must train with and is not a putter which can be used in play under the rules of golf.

The third class of sighting device is of the type which must be used in association with a particular putter. Generally the putter blade and sighting device have some form of complementary formations which are interengaged for mounting the device on the putter. Such devices essentially entail a combination of a specially constructed putter with a detachable sighting device. These devices not only suffer from the disadvantages of requiring a separate putter which cannot be used when playing under the rules of golf but are also optically unsatisfactory in that they only partially assist the player in putting the ball correctly in practice.

The final group of sighting devices are devices which it is claimed may be mounted on the blade of any putter and the blade is returned to its normal condition when the device is removed.

Optically, these devices are unsatisfactory in that while an inclined mirror on its own is of some assistance in lining a putt up correctly it is not fully accurate as the orientation of the putter face to the ball and the target path between the ball and pin will vary depending on the position of the player's eye. In addition, the device adversely effects the balance of the club with the result that if a ball is struck by the putter with the device attached with the same force as with the device removed not only will the ball be very unlikely to travel in the same direction but will not travel the same distance. In addition, the device described can only be mounted on putters having a shaft which extends from either end of the putter. Such putters are generally called bladed putters. It would be very difficult to use this device with a bladed putter having a curved back face and it would not be possible to mount such a device on a putter having a shaft which extends from the center of the putter blade—a so called center shafted putter.

In some of these devices, an inclined mirror is not sufficient to achieve the correct orientation of the putting face of a putter to a target line between the ball and pin as this will vary depending on the position of the player's eye. Further, the device can only be used with a putter blade having a flat continuous rear face. Only a relatively small percentage of putters presently on sale have such a flat continuous rear face. Further, such a device when attached to a putter adversely effects the normal balance of the putter and not only will a ball struck the same blow with the same putter with and without the sighting device attached be unlikely to travel in the same line but would also not travel the same distance.

Another problem in learning to putt is that greens are not typically flat. Many are sloped such that one often needs to aim the putter blade at a point which is to the left or right of the hole. It is important that a training system be able to provide feedback, regarding the relationship between where the putt is directed and where the ball travels and comes to rest. It is important that this feedback be learned from well aligned putts. Therefore, there is a need for a teaching device that will help a golfer learn to putt on greens that are not perfectly planar.

There is a need for a system and method for a golfer to learn the relationship between properly aligned putter face, the target and the path of the ball.

There is a need for a system and method for a learning golfer to systematically vary the direction in which the ball is targeted while maintaining proper eye position and putter face alignment.

The inventor has identified a need for a unitary device that can teach, and allow a golfer to practice on his own, the important basic skills of putting: proper club head path; proper club face angle at impact; proper posture and proper eye alignment; and green reading.

SUMMARY OF THE INVENTION

These, and other, objects are achieved by a unitary golf putting teaching device that achieves four goals: teaching proper club head path; teaching proper club face angle at impact; teaching proper posture and proper eye alignment; and teaching green reading.

Specifically, the device embodying the principles of the present invention comprises one sliding adjustable gate that would have two posts, similar to that of two tees, and act as a putter head gate with the putter moving through this head gate during the putting stroke with the head gate being adjustable to accommodate different size putter heads as well as to be able to increase the precision of a putting stroke by being narrowed as desired; a mirror located behind a ball that would allow the golfer to see if their eyes are over the line before starting their stroke; and an adjustable ball gate that is located downstream of the ball being struck so any error in club face angle at impact will be immediately evident. The adjustable ball gate is adjustable from ⅛" wider than the ball to ½" wider depending on the skill level of the golfer whereby a golfer can improve his or her skills during practice.

The device of the present invention also allows a golfer to improve their green reading skills. When the device is set up on the intended line, and the ball is stroked through both gates with the golfer's eyes over the line and with good speed and the ball does not hit the desired target, there is no doubt that the intended line was wrong and the golfer can adjust his or her green reading skills accordingly.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
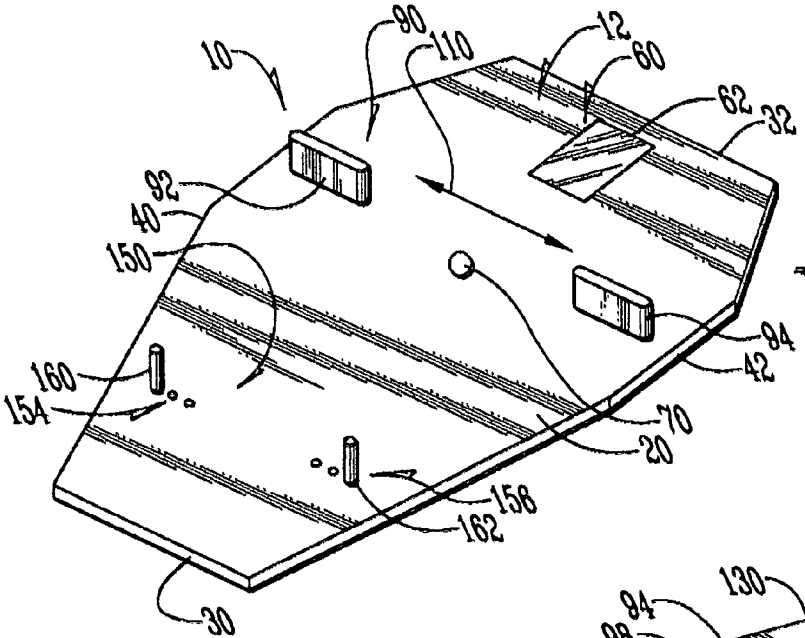
FIG. 1 is a top perspective view of a putting teaching device embodying the principles of the present invention.

Referring to the figures, it can be understood that the present invention is embodied in a putting stroke practice device 10 which comprises a base plate 12 that is placed on a putting surface and which has a first surface 20 which is a top surface when the base plate is in use, a second surface 22 which is a bottom surface when the base plate is in use, a first end 30 which is a front end when the base plate is in use, a second end 32 which is a rear end when the base plate is in use and a longitudinal axis 34 which extends between the first and second ends. Base plate 12 further includes a first side edge 40, a second side edge 42 and a transverse axis 44 which extends between the first and second side edges. Longitudinal axis 32 is positioned midway between the first and second side edges and defines a proper path for a ball which has been struck by a putter.

An anchor element 50 is connected at one end thereof to second surface 22 of the base plate and extends into an anchoring surface, such as the ground, to anchor the base plate in place on the anchoring surface. An eye alignment guide 60 includes a mirror 62 mounted on first surface 20 of the base plate near rear end 32 of the base plate. Mirror 62 is located to have a center axis 64 thereof co-linear with longitudinal axis 34 of the base plate. Eye alignment guide 60 indicates to a golfer if the golfer's eyes are aligned in a desired orientation prior to and during a putting stroke.

A ball mount 70 on the base plate positions a golf ball on the top surface of the base plate in position to be struck by a putter during a practice stroke. A putter swing path guide 90 is located adjacent to the mirror and adjacent to the ball mount and between the mirror and front end 30 of the base plate. As used herein, the term "downstream" will refer to a position closer to front end 30 than a reference position. As will be understood from the teaching of this disclosure, the golfer moves a putter through the putter swing path guide during a putting stroke so the putter swing path guide defines a proper swing path for the putter during the putting stroke.

Putter swing path guide 90 includes two posts 92 and 94 which are spaced apart from each other with the mirror and the longitudinal axis of the base plate being located between the two posts. The posts are identical and each post is located adjacent to a side edge of the base plate. Two slots 96 and 98 are defined through the base plate with a post extending through each slot so each of the posts is movably mounted on the base plate. Each slot extends in the direction of the transverse axis of the base plate.

Figure 2:
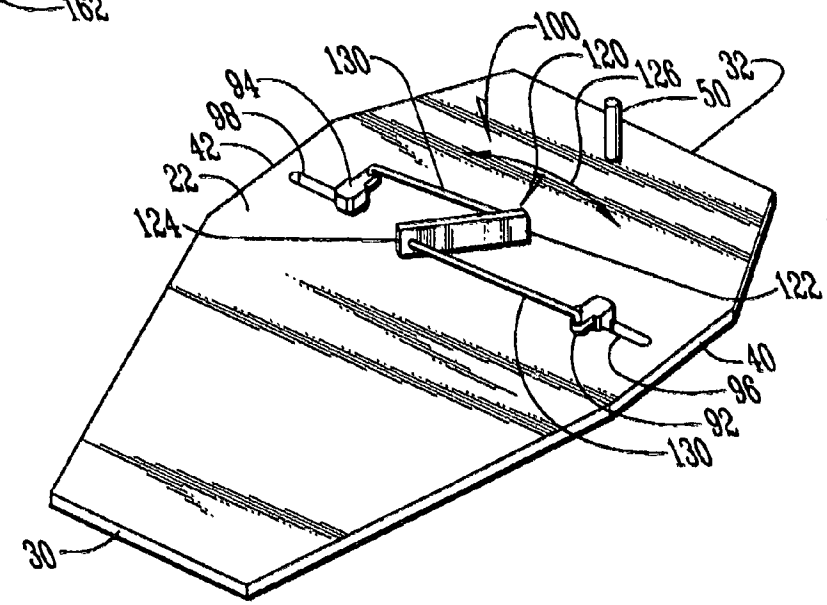
FIG. 2 is a bottom perspective view thereof.
Figure 3:
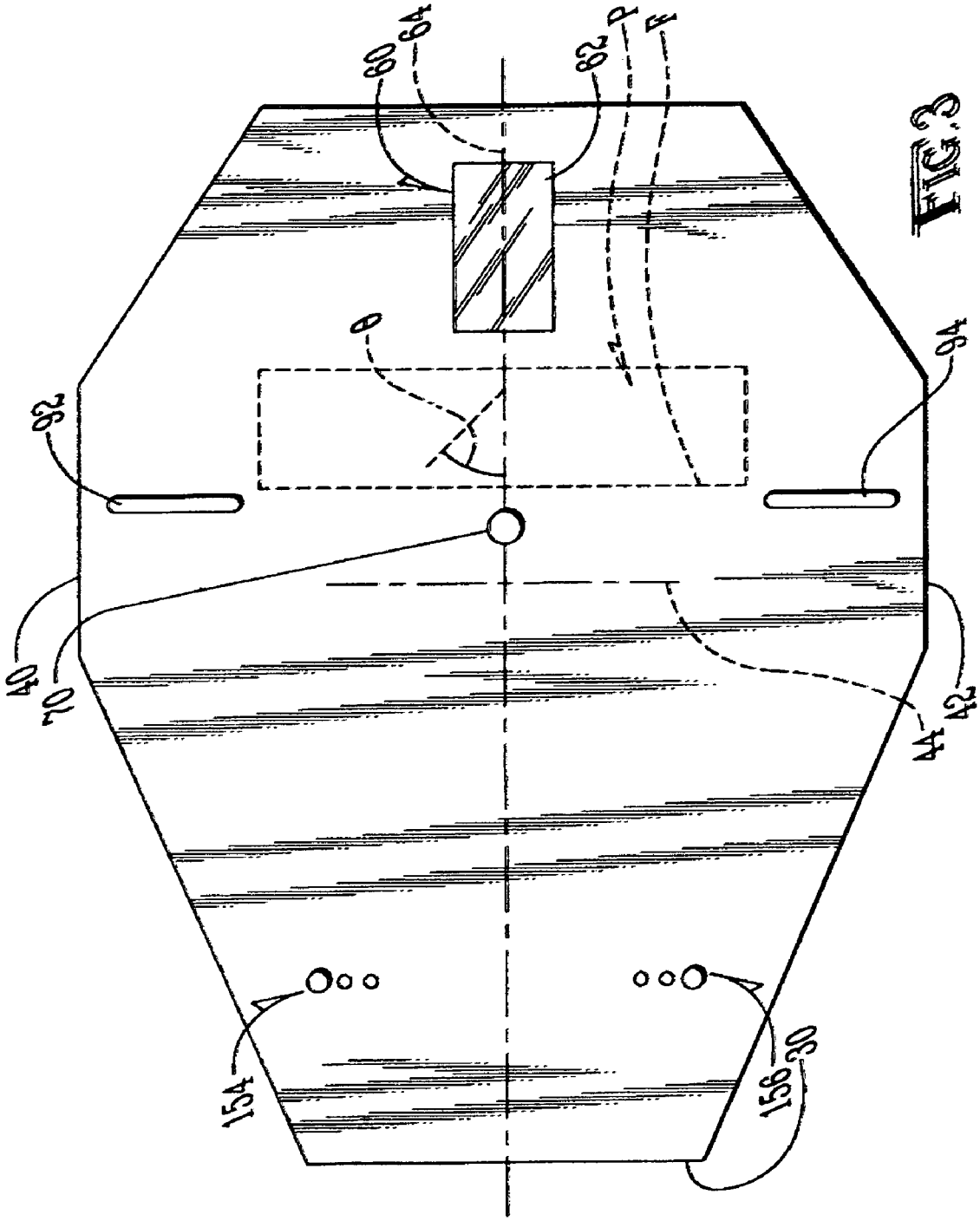
FIG. 3 is a top plan view thereof.

A post moving mechanism 100 is mounted on second surface 22 of the base plate and is operatively connected to the two posts to move the posts toward and away from each other in directions indicated by double-headed arrow 110 in FIG. 2. Post moving mechanism 100 includes an operating handle 120 rotatably mounted on second surface 22 of the base plate. Operating handle 120 has a rectangular shape with a first end 122 located adjacent to rear end 32 of the base plate and a second end 124 located so first end 122 of the operating handle is located between second end 124 and rear end 32 of the base plate. The ends of the operating handle move toward and away from the side edges of the base plate when the operating handle is rotated as indicated by double-headed arrow 126 in FIG. 2.

An operating arm 130 connects each post to one end of the operating handle to be moved in the direction of the transverse axis of the base plate when the operating handle is rotated. The putter will contact at least one of the posts if it moves off a desired path during the putting stroke so the golfer is immediately aware of an undesired stroke. The posts can be moved to accommodate putters of different sizes and can also be moved toward each other to reduce the margin of error associated with a stroke thereby increasing the precision of a stroke as desired.

Device 10 further comprises a putter face angle guide 150 which is located between putter swing path guide 90 and front end 30 of the base plate. The golf ball moves through the putter face angle guide after being struck so the putter face angle guide will indicate to the golfer when a face F of putter head P is oriented at an oblique angle, such as oblique angle θ with respect to the proper ball path when a ball located on the ball mount is struck during a practice stroke. Since longitudinal axis 34 is the proper ball path, angle θ is measured between a plane containing face F of putter P and axis 34. Putter face angle guide 150 includes a first plurality of mounting holes 154 defined in the top surface of the base plate with the first plurality of holes being located between the first side edge of the base plate and the longitudinal axis of the base plate and being spaced apart from each other in the direction of the transverse axis of the base plate. A second plurality 156 of mounting holes are defined in the top surface of the base plate with the second plurality of holes being located between the second side edge of the base plate and the longitudinal axis of the base plate and being spaced apart from each other in the direction of the transverse axis of the base plate. The mounting holes are blind-ended bores which extend from the top surface of the mounting plate towards the bottom surface of the mounting plate.

A first ball post 160 is mounted in one of the first plurality of holes and a second ball post 162 is mounted in one of the second plurality of holes. As can be understood from the foregoing, if the ball is struck with a putter face angle that is oblique to the desired line, the ball will impact one of the posts and the golfer will be immediately aware of an off-angle orientation of the putter face. The posts can be moved toward each other to reduce the margin of error associated with a putting stroke so a smaller face angle will cause the ball to strike one of the posts. In this way, the golfer can increase the practice level as desired.

As above discussed, if the golfer knows their eyes are properly aligned, and knows the swing is proper and knows the club face is at a proper angle, yet the ball does not strike the target, then the golfer will know that he or she misread the path between the initial ball placement and the target. Accordingly, the device of the present invention allows a golfer to practice reading greens as well.

As can be understood from the foregoing, a method of practicing a golf putting stroke using device 10 includes: using the mirror to ensure proper eye alignment with respect to a desired putting line for a ball being putted prior to and during a putting stroke by allowing a golfer to see if their eyes are over the desired putting line prior to and during the putting stroke; using putter swing path guide 90 to ensure proper putter swing path during a putting stroke using an adjustable gate which will be impacted by a putter head if the putter head is moving at an angle with respect to a desired putter movement; and using putter face angle guide 150 to ensure proper putter face angle at impact between the putter and a ball during a putting stroke using an adjustable gate and causing the ball to impact the gate if the ball has been struck by a putter having a face oriented at an angle that is not desired. The teaching method can be modified to increase the difficulty of clearing the swing path guide and/or increasing the difficulty of having a ball clear the posts of the putter face angle guide to increase the precision required in the golfer's swing. As was discussed above, device 10 can also be used to teach a golfer to read greens.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A putting stroke practice device comprising:

A) a base plate having
  (1) a first surface which is a top surface when the base plate is in use,
  (2) a second surface which is a bottom surface when the base plate is in use,
  (3) a first end which is a front end when the base plate is in use,
  (4) a second end which is a rear end when the base plate is in use,
  (5) a longitudinal axis which extends between the first and second ends,
  (6) a first side edge,
  (7) a second side edge, and
  (8) a transverse axis which extends between the first and second side edges; the longitudinal axis being positioned midway between the first and second side edges and defining a proper path for a ball which has been struck by a putter;

B) an anchor element connected at one end thereof to the second surface of the base plate and extending into an anchoring surface to anchor the base plate in place on the anchoring surface;

C) an eye alignment guide which includes a mirror mounted on the first surface of the base plate near the rear end of the base plate, the mirror being located to have a center axis thereof co-linear with the longitudinal axis of the base plate, the eye alignment guide indicating to a golfer if the golfer's eyes are aligned in a desired orientation prior to and during a putting stroke;

D) a ball mount for positioning a golf ball on the top surface of the base plate in position to be struck by a putter during a practice stroke;

E) a putter swing path guide located adjacent to the mirror and adjacent to the ball mount and between the mirror and the front end of the base plate, the golfer moving a putter through the putter swing path guide during a putting stroke with the putter swing path guide defining a proper swing path for the putter during the putting stroke and including
  (1) two posts which are spaced apart from each other with the mirror and the longitudinal axis of the base plate being located between the two posts, each post being located adjacent to a side edge of the base plate,
  (2) two slots defined through the base plate with a post extending through each slot so each of the posts is movably mounted on the base plate, each slot extending in the direction of the transverse axis of the base plate,
  (3) a post moving mechanism mounted on the second surface of the base plate and being operatively connected to the two posts to move the posts toward and away from each other, the post moving mechanism including (a) an operating handle rotatably mounted on the second surface of the base plate, the operating handle having a rectangular shape with a first end located adjacent to the rear end of the base plate and a second end located so the first end of the operating handle is located between the second end and the rear end of the base plate, the ends of the operating handle moving toward and away from the side edges of the base plate when the operating handle is rotated, and (b) an operating arm connecting each post to one end of the operating handle to be moved in the direction of the transverse axis of the base plate when the operating handle is rotated; and F) a putter face angle guide located between the putter swing path guide and the front end of the base plate, the ball moving through the putter face angle guide after being struck, and the putter face angle guide indicating to a golfer when a face of the putter is oriented at an oblique angle with respect to the proper ball path when a ball located on the ball mount is struck during a practice stroke and including (1) a first plurality of mounting holes defined in the top surface of the base plate with the first plurality of holes being located between the first side edge of the base plate and the longitudinal axis of the base plate and being spaced apart from each other in the direction of the transverse axis of the base plate, (2) a second plurality of mounting holes defined in the top surface of the base plate with the second plurality of holes being located between the second side edge of the base plate and the longitudinal axis of the base plate and being spaced apart from each other in the direction of the transverse axis of the base plate, (3) a first ball post mounted in one of the first plurality of holes, and (4) a second ball post mounted in one of the second plurality of holes.

* * * * *